US006354588B1

(12) United States Patent
Kuwahara et al.

(10) Patent No.: US 6,354,588 B1
(45) Date of Patent: Mar. 12, 2002

(54) DISCHARGED PAPER RECEIVER UNIT

(75) Inventors: Yoshiya Kuwahara; Hideyuki Sekiguchi; Kazuhiro Kato; Yasuji Ikari, all of Amimachi (JP)

(73) Assignee: Riso Kagaku Corporation (JP)

( * ) Notice: Subject to any disclaimer, the term of this patent is extended or adjusted under 35 U.S.C. 154(b) by 0 days.

(21) Appl. No.: 09/471,358

(22) Filed: Dec. 23, 1999

(30) Foreign Application Priority Data

Dec. 28, 1998 (JP) ..... 10-373613

(51) Int. Cl.[7] ..... B65H 31/20
(52) U.S. Cl. ..... 271/224
(58) Field of Search ..... 271/223, 224

(56) References Cited

U.S. PATENT DOCUMENTS 2,733,064 A * 1/1956 Martin ..... 271/224
3,907,128 A * 9/1975 Cathers ..... 271/224

FOREIGN PATENT DOCUMENTS

EP 0 788 994 A2 8/1997
EP 0 864 521 A2 9/1998
JP 63-143172 * 6/1988 ..... 271/224
JP 8-20468 1/1996
JP 08020468 1/1996
JP 08259082 10/1996

* cited by examiner

*Primary Examiner*—Christopher P. Ellis
*Assistant Examiner*—Mark A. Deuble
(74) *Attorney, Agent, or Firm*—Nixon Peabody LLP; Donald R. Studebaker

(57) ABSTRACT

A discharged paper receiver unit for receiving papers discharged from an image recording apparatus has a bottom plate on which papers discharged from the image recording apparatus are stacked and which is positioned with its one end held lower than the other at least when the discharged paper receiver unit is set in its operative position. A stopper member has a cushioning portion positioned so that the leading end of each paper as discharged from the image recording apparatus directly impacts against the cushioning portion and the paper falls onto the bottom plate. An end lining-up member is provided near the end of the bottom plate which is held lower than the other when the discharged paper receiver unit is in its operative position, is positioned so that the leading end of each paper as discharged from the image recording apparatus cannot directly impact against the end lining-up member before impacting the cushioning portion, and is provided with a lining-up surface which is erected from the bottom plate and against which one end of the paper is brought into abutment after the leading end of the paper impacts against the cushioning portion.

9 Claims, 4 Drawing Sheets

DISCHARGED PAPER RECEIVER UNIT

BACKGROUND OF THE INVENTION

1. Field of the Invention

This invention relates to a discharged paper receiver unit for an image recording apparatus such as a copier, printer or the like, and more particularly to a discharged paper receiver unit on which a plurality of papers automatically discharged from such an image recording apparatus continuously one by one are stacked with their edges lined up.

2. Description of the Related Art

There have been known various image recording apparatuses in which a plurality of papers are continuously discharged one by one onto a discharged paper receiver unit.

Conventional discharged paper receiver units generally comprise a tray on which papers are stacked, an end fence which is erected from the tray so that the papers discharged from the image recording apparatuses impact against the end fence, and a pair of side fences which line up the side edges (the edges parallel to the direction of discharge of the papers) of the papers. The end fence is slidable back and forth in the direction of discharge of the papers according to the length (the size of the papers as measured in the direction of discharge of the papers) of the papers to be discharged from the image recording apparatus. The side fences are slidable toward and away from each other in the direction transverse to the direction of discharge of the papers according to the width of the papers to be discharged. The end fence and the side fences are collapsible, and when the image recording apparatus is not used, the discharged paper receiver unit is housed in a cabinet on the image recording apparatus with the fences collapsed.

In the conventional discharged paper receiver units, the end fence functions as both a stopper member which stops the papers discharged from the image recording apparatus and an end lining up member which lines up the leading ends of the papers, thereby bringing the papers in alignment with each other in the longitudinal direction of the papers (in the direction of discharge of the papers).

Generally the end face has been formed of synthetic resin such as ABS resin, PS resin or PC resin. Accordingly a large sound is generated each time the paper impacts against the end fence.

There has been made an attempt to suppress the impact sound by providing a cushioning member such as of sponge on the end fence in a position where the papers impact against the end fence.

However when the sponge is exposed, the leading ends of the papers are apt to be caught by the rough surface of the sponge so that the papers are hung from the sponge, which adversely affects lining up the leading ends of the papers, though the impact sounds can be well suppressed. To the contrast, when the surface of the sponge is covered, for instance, with resin film to provide a smooth surface, the cushioning effect deteriorates and the impact sound cannot be sufficiently suppressed though the lining up the leading ends of papers can be well performed.

In Japanese Unexamined Patent Publication No. 8(1996)-20468, there is disclosed a mechanism for suppressing the impact sound by erecting a thin plate member formed of a resilient material in front of the end fence. The thin plate member is deflected by its own weight toward the paper discharge port of the image recording apparatus and when the paper impacts against the thin plate member, kinetic energy of the paper is absorbed by the thin plate member and the impact sound is suppressed. However, this approach is disadvantageous in that deflection toward the paper discharge port of the thin plate member adversely affects lining up the leading ends of the papers and, at the same time, as the number of papers stacked on the tray increases and the weight of the stack of papers acting on the thin plate material increases, cushioning effect of the thin plate member deteriorates and the impact sound gradually becomes larger.

SUMMARY OF THE INVENTION

In view of the foregoing observations and description, the primary object of the present invention is to provide a discharged paper receiver unit which can suppress the impact sound generated upon stopping the discharged paper and, at the same time, can well line up the ends of the papers.

The discharged paper receiver unit in accordance with the present invention is for receiving papers discharged from an image recording apparatus such as a copier, printer or the like and comprises

- a bottom plate on which papers discharged from the image recording apparatus are stacked and which is positioned with its one end held lower than the other at least when the discharged paper receiver unit is set in its operative position,
- a stopper member having a cushioning portion positioned so that the leading end of each paper as discharged from the image recording apparatus directly impacts against the cushioning portion and the paper falls onto the bottom plate, and
- an end lining-up member which is provided near the end of the bottom plate which is held lower than the other when the discharged paper receiver unit is in its operative position, is positioned so that the leading end of each paper as discharged from the image recording apparatus cannot directly impact against the end lining-up member before impacting cushioning portion, and is provided with a lining-up surface which is erected from the bottom plate and against which one end of the paper is brought into abutment after the leading end of the paper impacts against the cushioning portion.

In the discharged paper receiver unit of the present invention, the cushioning portion of the stopper member stops the paper discharged from the image recording apparatus and absorbs kinetic energy of the discharged paper by rebounding the discharged paper, whereby the impact sound is suppressed. Since the end lining-up member lines up the ends of the papers and the cushioning portion plays no part in lining up the ends of the papers, the surface of the cushioning portion need not be smooth. Accordingly, the cushioning portion may be formed of a cushioning material such as sponge rubber or sponge resin without any cover which can increase the impact sound. The cushioning portion may extend either from the surface of the bottom plate to an area including a height where the leading end of the discharged paper is expected to pass or only over an area including a height where the leading end of the discharged paper is expected to pass. The height where the leading end of the discharged paper is expected to pass varies according to the size of the paper, the thickness of the paper, the speed at which the paper is discharged and the like, and can be determined, for instance, empirically. It is preferred that the height of the cushioning portion is adjustable.

Further since kinetic energy of the paper to be absorbed by the cushioning portion varies according to the size of the paper, the thickness of the paper, the speed at which the paper is discharged and the like, it is preferred that the material of the cushioning portion can be changed. This can be realized by changing the stopper member together with the cushioning portion or by removably mounting the cushioning portion on the stopper member and changing only the cushioning portion.

The paper is generally discharged in a curled state with its side edges directed upward in order to facilitate discharge of the paper. In such a case, when the leading end of the paper abuts against the cushioning portion over the entire length of the leading end, a paper spreading sound is generated when the paper spreads. When the cushioning portion is narrower than the width of the leading end of the paper to be discharged from the image recording apparatus and is positioned so that the leading end of the paper impacts against the cushioning portion only at a middle portion thereof, impact energy is released in a manner such that the impact energy propagates outward from the middle portion of the paper, and a part of the impact energy can be absorbed and generation of the paper spreading sound is prevented.

The end lining-up member is disposed near the end of the bottom plate which is held lower than the other end, and the paper rebound by the cushioning portion slides along the inclined surface of the bottom plate and is stopped by the end lining-up member with its one end abutting against the lining-up surface of the end lining-up member, whereby the ends of the papers are lined up. For this purpose, it is preferred that the lining-up surface be smooth and may be formed of synthetic resin such as ABS resin, PS resin, PC resin or the like which has been used for the conventional end fence. Though the bottom plate may be inclined either so that the upstream end thereof (the end nearer to the image recording apparatus) is lower than the downstream end thereof or so that the downstream end is lower than the upstream end, it is preferred that the bottom plate be inclined in the latter manner.

The stopper member and the end lining-up member may be formed either integrally or separately from each other.

It is preferred that the stopper member and the end lining-up member be movable back and forth in the paper discharge direction in which the papers are discharged from the image recording apparatus so that the position of the cushioning portion and the lining-up surface can be adjusted according to the size of the paper.

It is further preferred that the stopper member and the end lining-up member be movable back and forth in the paper discharge direction independently of each other.

Further, in the discharged paper receiver unit of this embodiment, since the weight of the stack of the papers does not act on the stopper member, the cushioning performance of the stopper member (the cushioning portion) is kept unchanged even if the number of papers in the stack increases and the weight of the stack is increased.

DESCRIPTION OF THE PREFERRED EMBODIMENTS

Figure 1:
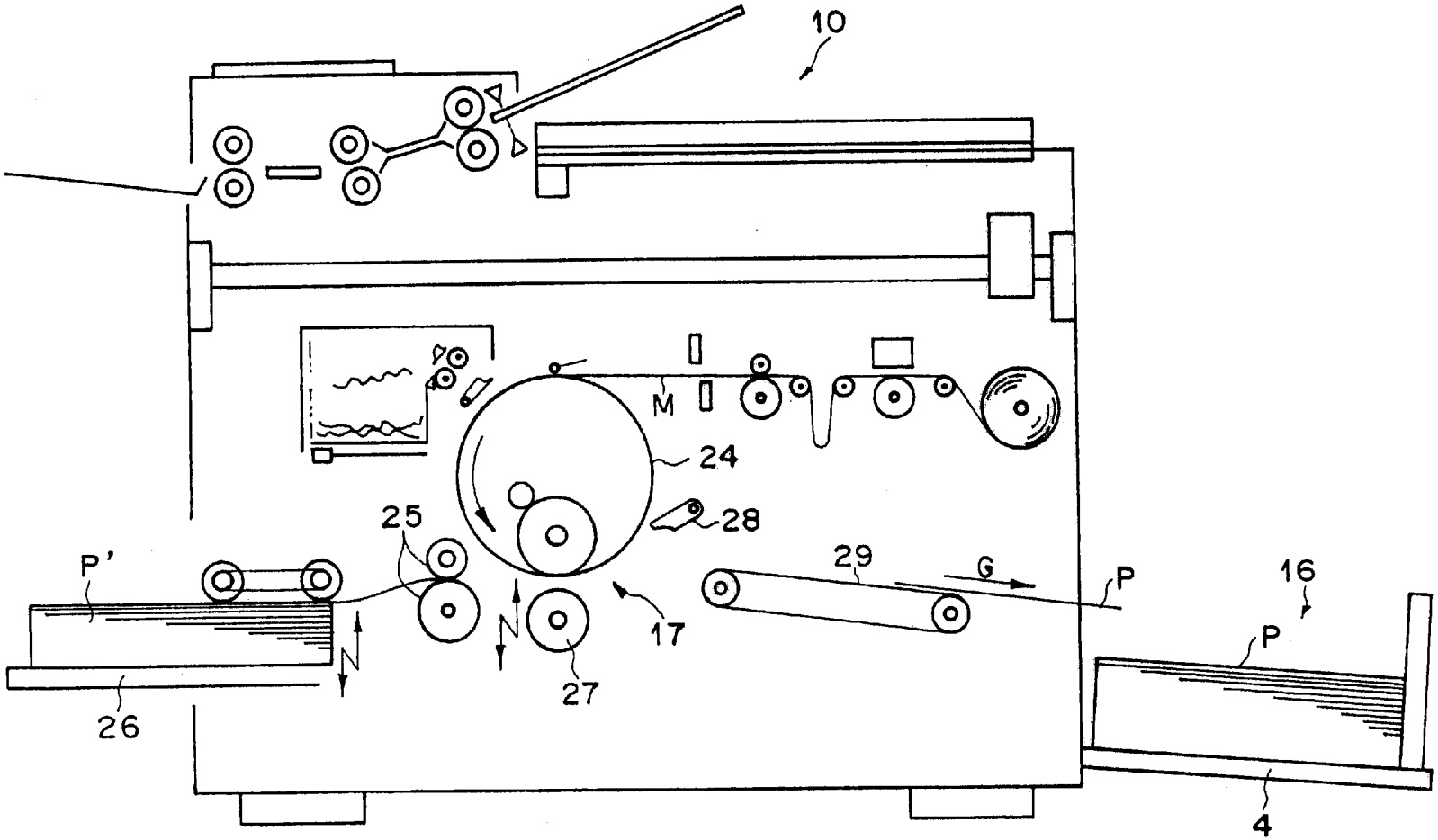
FIG. 1 is a schematic view showing a stencil printer with a stencil master making system as an image recording apparatus provided with a discharged paper receiver unit to which the present invention is applied.

FIG. 1 shows a stencil printer with a stencil master making system as an image recording apparatus provided with a discharged paper receiver unit to which the present invention is applied. In FIG. 1, the stencil printer 10 has a stencil master making section in which a stencil master is made by imagewise perforating a heat-sensitive stencil master material M in a dot matrix pattern. The stencil master thus made is wound around the peripheral wall of a printing drum 24 in a printing section 17. A printing paper p' is fed between the printing drum 24, bearing thereon the stencil master, and a press roller 27 from a paper supply table 26 at a predetermined timing in synchronization with rotation of the printing drum 24 by a pair of timing rollers 25. The printing paper P' is pressed against the stencil master on the printing drum 24 by the press roller 25 and ink is transferred to the printing paper P' through the stencil master, whereby an image is printed on the printing paper P'. After printing, the printed paper P' (will be referred to as "the discharged paper P", hereinbelow) is separated from the printing drum 24 by a separator 28 and is conveyed by a discharge paper conveyor system 29. Then the discharged paper P is discharged into a discharged paper receiver unit 16 with its printed surface facing upward.

The present invention is to improve the discharged paper receiver unit 16. A discharged paper receiver unit 16 in accordance with a first embodiment of the present invention will be described with reference to FIGS. 2 to 4, hereinbelow.

Figure 2:
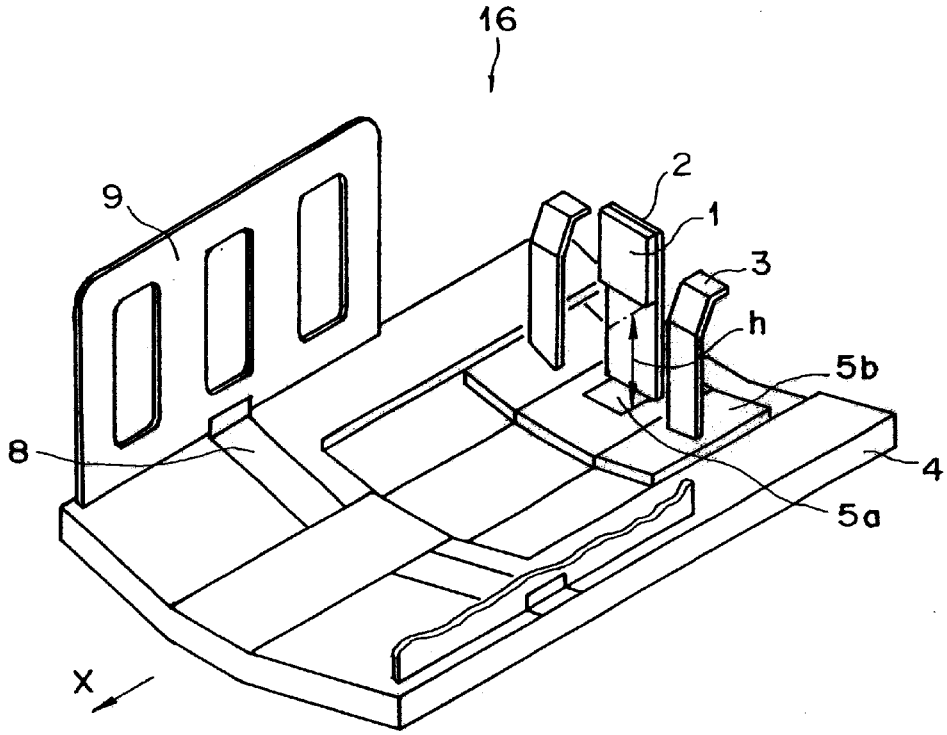
FIG. 2 is a perspective view partly cut away showing a discharged paper receiver unit in accordance with a first embodiment of the present invention.
Figure 3:
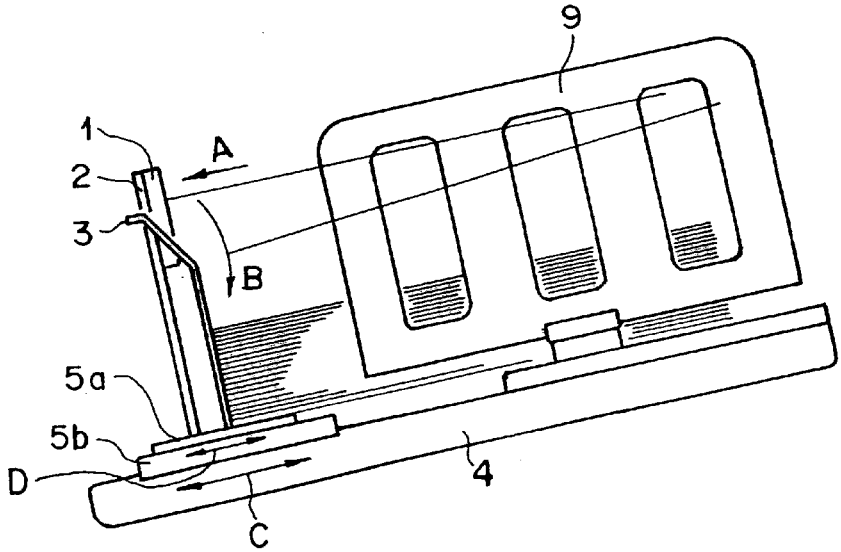
FIG. 3 is a side view of the discharged paper receiver unit.
Figure 4:
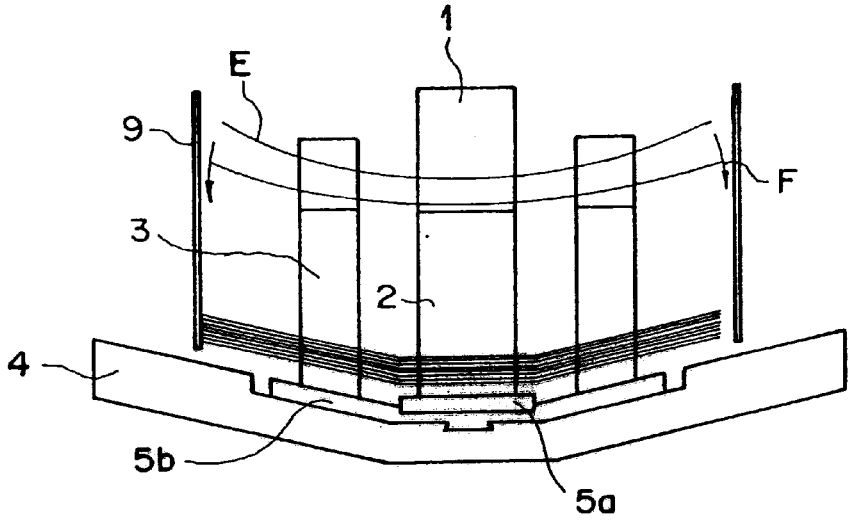
FIG. 4 is a transverse cross-sectional view of the discharged paper receiver unit.

In FIGS. 2 to 4, the discharged paper receiver unit 16 of this embodiment comprises a bottom plate 4, a stopper member 2 which is erected from the bottom plate 4 and is provided with a cushioning portion 1, and an end lining-up member comprising a pair of lining-up pieces 3 disposed on opposite sides of the stopper member 2.

In this embodiment, the discharged paper receiver unit 16 is disposed with respect to the stencil printer 10 so that the bottom plate 4 is inclined with respect to the horizontal with its downstream end (the end remote from the stencil printer 10) held lower than its upstream end. The stopper member 2 and the end lining-up member are disposed near the downstream end of the bottom plate 4. When the discharged paper receiver unit 16 is disposed with respect to the stencil printer 10 with the upstream end of the bottom plate held lower than the downstream end, the stopper member 2 is disposed near the downstream end of the bottom plate 4 and the end lining-up member is disposed near the upstream end of the bottom plate 4.

The cushioning portion 1 is formed of sponge or rubber material several millimeters thick having cushioning effect and is positioned so that the discharged paper P as discharged from the stencil printer 10 directly impacts against the cushioning portion 1. In this particular embodiment,the cushioning portion 1 extends over the upper one third of the stopper member 2. Since the height where the leading end of the discharged paper P is expected to pass changes according to various factors such as the size of the discharged paper P, the ratio of printed area to the size of the paper P and the like, the stopper member 2 is arranged to be able to move up and down the cushioning portion 1. Further since kinetic energy of the paper P to be absorbed by the cushioning portion 1 varies according to the kind and quality of the paper P and the like, the cushioning portion 1 is arranged to be exchangeable. The cushioning portion 1 may be provided on the stopper member 2 to extend over the entire length thereof.

The discharged paper receiver unit 16 of this embodiment is inserted into the stencil printer 10 in the direction of arrow X in FIG. 2 and is held by the stencil printer 10 so that the bottom plate 4 is inclined with respect to the horizontal with its downstream end held lower than its upstream end as described above.

Further left and right side fences 9 are mounted on the bottom plate 4 by way of a slide base 8 to be slidable in the transverse direction according to the width (the size as measured in the direction transverse to the direction of discharge of the paper P shown by arrow C in FIG. 3) of the discharged paper P.

The stopper member 2 is, for instance, about 20 cm in height and is supported by a slide mechanism (not shown) to be slidable up and down to change the height of the cushioning portion 1 as described above. Further, the stopper member 2 is mounted on a slide base 5*a* which is mounted on a slide base 5*b* to be slidable back and forth in the direction of discharge of the paper P relative to the slide base 5*b*. The slide base 5*b* is mounted on the bottom plate 4 to be slidable back and forth in the direction of discharge of the paper P relative to the bottom plate 4 as shown by double-headed arrow D in FIG. 3. The lining-up pieces 3 are mounted on the slide base 5*b*. Accordingly, the stopper member 2 together with the cushioning portion 1 is slidable in the direction of discharge of the paper P relative to the lining-up pieces 3 and is slidable in the direction of discharge of the paper P relative to the bottom plate 4 integrally with the lining-up pieces 3.

Each of the lining-up pieces 3 of the end lining-up member is erected upward from the bottom plate 4 in front of the stopper member 2 but is inclined rearward at a portion higher than the lower end of the cushioning portion 1 (the height of the lower end of the cushioning 1 is indicated at h in FIG. 2) so that the leading end of the discharged paper P does not directly impact against the lining-up piece 3. When the leading end of the discharged paper P impacts against the cushioning portion 1 as shown by arrow A in FIG. 3, the discharged paper P is rebound by the cushioning portion 1 as shown by arrow B and then falls toward the bottom plate 4. When the discharged paper P falls toward the bottom plate 4, the leading end of the paper P is guided by the surfaces of the lining-up pieces 3 facing the stencil printed 10 and the side edges of the paper P are guided by the side fences 9, whereby the discharged papers P are aligned with each other in both the direction of discharge and the direction transverse to the direction of discharge. Since the lining-up pieces 3 guide the leading end of the discharged paper P, it is preferred that the lining-up pieces 3 be formed of a material such as ABS resin, PS resin or PC resin which provides a smooth surface. Even if the lining-up pieces 3 are formed of such a material, no impact sound is generated since the discharged paper P does not impact against the lining-up pieces 3.

Thus in the discharged paper receiver unit 16 of this embodiment, since the discharged paper P is stopped by the cushioning portion 1 formed of a cushioning material such as rubber sponge or resin sponge, the impact sound can be suppressed, and since lining of the leading ends of the discharged papers P is effected by the lining-up pieces 3 having smooth surfaces, the leading ends of the discharged papers P can be well lined up. Further since the lining-up pieces 3 are disposed in front of the stopper member 2, and the weight of the stack of the discharged papers P does not act on the stopper member 2, the cushioning performance of the stopper member 2 (the cushioning portion 1) is kept unchanged even if the number of papers P in the stack increases and the weight of the stack is increased.

The paper P is generally discharged in a curled state with its side edges directed upward as indicated at E in FIG. 4 in order to increase the bending rigidity of the paper P and facilitate discharge of the paper P. With this arrangement, the paper P can directly impact against the cushioning portion 1 without interfered with by the side fences 9. After rebounded by the cushioning portion 1, the paper P falls downward while spreading under its rigidity. However the side edges of the paper P abut against the side fences 9 as shown by arrow F in FIG. 4 and spread of the paper P is limited, whereby the papers P are aligned with each other in the direction transverse to the direction of discharge of the papers P.

As can be seen from FIG. 2, the cushioning portion 1 is clearly narrower than the length of the leading end of each paper and is positioned at the middle between the side edges of the bottom plate 4. When the leading end of the paper P abuts against the cushioning portion 1 over the entire length of the leading end, a paper spreading sound is generated when the paper spreads. When the cushioning portion 1 is narrower than the width of the leading end of the paper P and is positioned so that the leading end of the paper P impacts against the cushioning portion 1 only at a middle portion thereof, impact energy is released in a manner such that the impact energy propagates outward from the middle portion of the paper P, and a part of the impact energy can be absorbed and generation of the paper spreading sound is prevented.

Since the stopper member 1 and the lining-up pieces 3 are integrally movable in the direction of discharge of the paper P as described above, they are adjusted to an optimal position according to the size of the paper P and the like. Further the position of the stopper member 2 relative to the lining-up pieces 3 can be adjusted, for instance, according to the distance by which the paper P is expected to be rebounded since the stopper member 2 is movable relative to the lining-up pieces 3 as described above.

The stopper 2, the lining-up pieces 3 and the side fences 9 are collapsible and are collapsed when the discharged paper receiver unit 16*b* is housed in a cabinet of the stencil printer 10 or the like.

Figure 5:
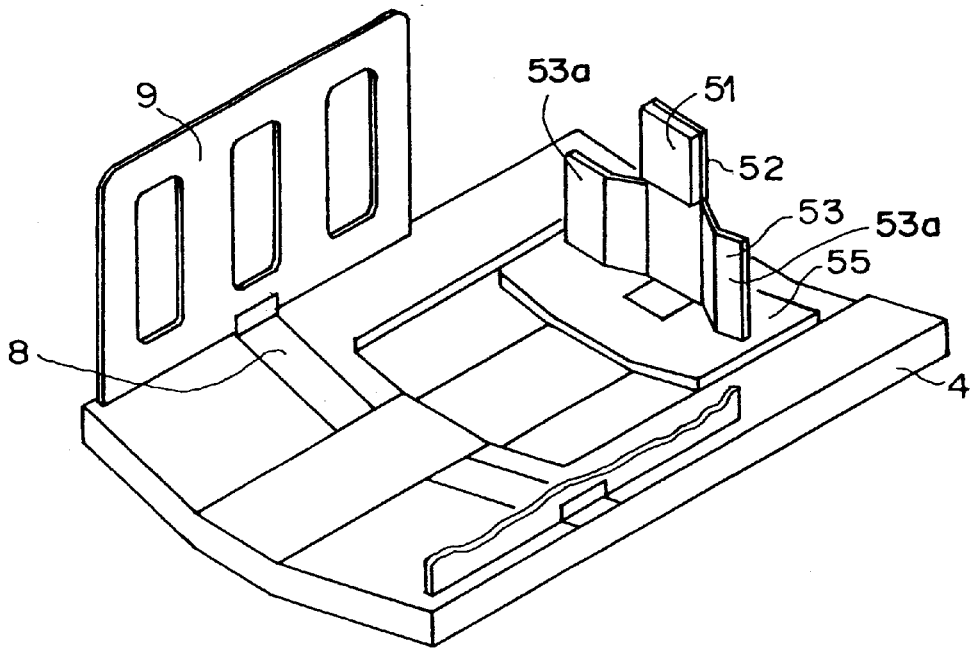
FIG. 5 is a perspective view of a discharged paper receiver unit in accordance with a second embodiment of the present invention.

Though, in the first embodiment, the end lining-up member comprises a pair of lining-up pieces 3 which are separate from each other and from the stopper member 2, the end lining-up member may be of one piece. For example, in the second embodiment shown in FIG. 5, a one-piece end lining-up member 53 is formed integrally with a stopper member 52 which supports a cushioning portion 51. The end lining-up member 53 is provided with a pair of lining-up surfaces 53*a* on opposite sides of the stopper member 52. The lining-up surfaces 53*a* are disposed forward of the cushioning portion 51 so that the leading end of the discharged paper P rebound by the cushioning portion 51 abuts against the lining-up surfaces 53*a*. Further since the lining-up surfaces 53*a* are disposed forward of the cushioning portion 51, the weight of the stack of the papers P cannot directly act on the stopper member 52, whereby the cushioning performance of the stopper member 52 (the cushioning portion 51) is kept unchanged even if the number of papers P in the stack increases and the weight of the stack is increased as in the first embodiment. In this embodiment, the upper edge of the end lining-up member 53 is lower than the lower end of the cushioning portion 51 not to interfere with the leading end of the discharged paper P before the leading end impacts against the cushioning portion 51. Further, the stopper member 52 and the end lining-up member 53 are mounted on a slide base 55 which is mounted on the bottom plate 4 to be slidable in the direction of discharge of the paper P.

Figure 6:
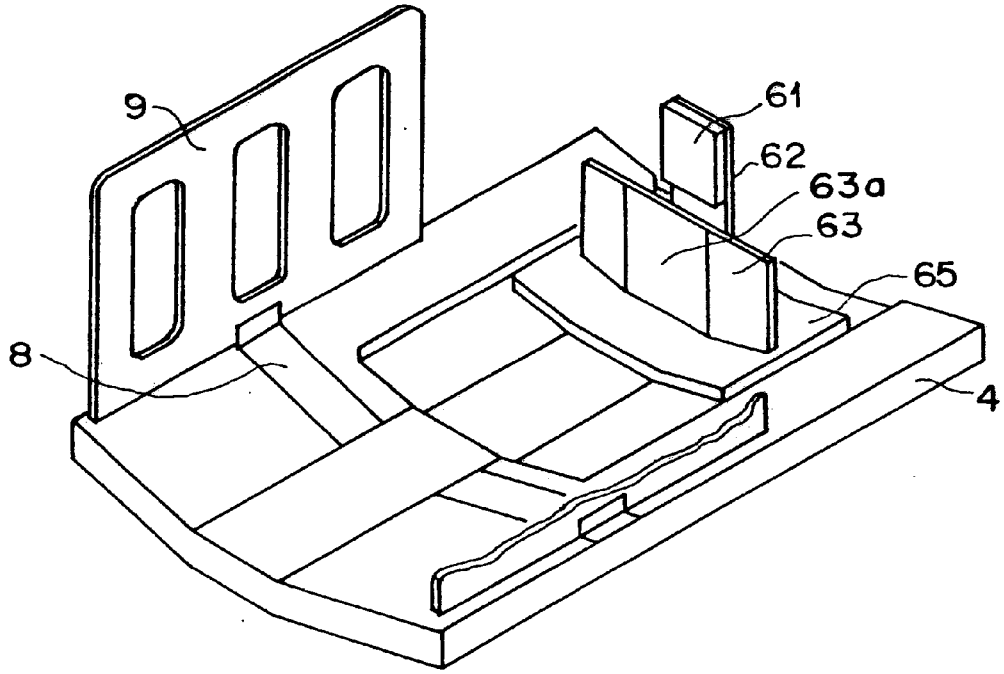
FIG. 6 is a perspective view of a discharged paper receiver unit in accordance with a third embodiment of the present invention .

In the third embodiment shown in FIG. 6, a one-piece end lining-up member 63 has a wide lining-up surface and is formed separately from a stopper member 62 provided with a cushioning portion 61. The lining-up surface 63*a* is disposed forward of the cushioning portion 61 so that the leading end of the discharged paper P rebound by the cushioning portion 61 abuts against the lining-up surface 63*a*. Further since the lining-up surface 63*a* is disposed forward of the cushioning portion 61, the weight of the stack of the papers P cannot directly act on the stopper member 62, whereby the cushioning performance of the stopper member 62 (the cushioning portion 61) is kept unchanged even if the number of papers P in the stack increases and the weight of the stack is increased as in the first embodiment. In this embodiment, the upper edge of the end lining-up member 63 is lower than the lower end of the cushioning portion 61 not to interfere with the leading end of the discharged paper P before the leading end impacts against the cushioning portion 61. Further, the stopper member 62 and the end lining-up member 63 are mounted on a slide base 65 which is mounted on the bottom plate 4 to be slidable in the direction of discharge of the paper P.

What is claimed is:

1. A discharged paper receiver unit for receiving papers discharged from an image recording apparatus comprising:

a bottom plate on which papers discharged from the image recording apparatus are stacked, said bottom plate including a first end positioned adjacent to the image recording apparatus and a second end positioned distal to and lower than said first end at least when the discharged paper receiver unit is set in an operative position;

a stopper member having a cushioning portion substantially positioned in a first plane relative to said bottom plate so that a leading end of each paper as discharged from the image recording apparatus directly impacts against the cushioning portion and falls onto the bottom plate; and an end lining-up member substantially positioned in a second plane relative to said bottom plate adjacent to the second end of the bottom plate, said second plate being forward of said first plate including the stopper member with said end lining up member being positioned so that the leading end of each paper as discharged from the image recording apparatus cannot directly impact against the end-lining up member before impacting the cushioning portion, said end lining-up member having a lining-up surface positioned in said second plane which is erected from the bottom plate and against which one end of the paper is brought into abutment after the leading end of the paper impacts against the cushioning portion.

2. A discharged paper receiver unit as defined in claim 1 in which the cushioning portion is formed of a cushioning material removably attached to the stopper member.

3. A discharged paper receiver unit as defined in claim 2 in which the cushioning material is composed of sponge rubber or sponge resin.

4. A discharged paper receiver unit as defined in claim 1 in which the stopper member together with the cushioning portion is exchangeable.

5. A discharged paper receiver unit as defined in claim 1 in which the stopper member and the end lining-up member are formed separately from each other.

6. A discharged paper receiver unit as defined in claim 1 in which the stopper member and the end lining-up member are movable back and forth in the paper discharge direction.

7. A discharged paper receiver unit as defined in claim 1 in which the cushioning portion is movable toward and away from the bottom plate.

8. A discharged paper receiver unit as defined in claim 1 in which the cushioning portion is narrower than the width of the leading end of the paper to be discharged from the image recording apparatus and is positioned so that the leading end of the paper impacts against the cushioning portion only at a middle portion of the cushioning portion.

9. A discharged paper receiver unit for receiving papers discharged from an image recording apparatus comprising:

a bottom plate on which papers discharged from the image recording apparatus are stacked, said bottom plate including a first end positioned adjacent to the image recording apparatus and a second end positioned distal to and lower than said first end at least when the discharged paper receiver unit is set in an operative position;

a stopper member having a cushioning portion positioned so that the leading end of each paper as discharged from the image recording apparatus directly impacts against the cushioning portion and falls onto the bottom plate; and an end lining-up member positioned adjacent to the second end of the bottom plate and forward of the stopper member so that the leading end of each paper as discharged from the image recording apparatus cannot directly impact against the end-lining up member before impacting the cushioning portion, said end lining-up member having a lining-up surface which is erected from the bottom plate and against which one end of the paper is brought into abutment after the leading end of the paper impacts against the cushioning portion, wherein the stopper member and the end lining-up member are movable back and forth in the paper discharge direction independently of each other.

* * * * *